US006145867A

United States Patent [19]

Bourdeau

[11] Patent Number: 6,145,867

[45] **Date of Patent: *Nov. 14, 2000**

[54] SHOE/SHOE RETENTION DEVICE ASSEMBLY ON GLIDING ELEMENT

[75] Inventor: Joel Bourdeau, Saint-Jorioz, France

[73] Assignee: Salomon S.A., Metz-Tessy, France

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/222,874

[22] Filed: Dec. 30, 1998

Related U.S. Application Data

[63] Continuation of application No. 08/592,289, filed as application No. PCT/FR95/00846, Jun. 26, 1995, Pat. No. 5,887,886, and a continuation-in-part of application No. 08/224,142, Apr. 4, 1994, Pat. No. 5,595,396.

[30] Foreign Application Priority Data

May 14, 1993 [FR] France ..... 93 06006
Jul. 12, 1994 [FR] France ..... 94 08872

[51] Int. Cl.[7] ..... A63C 9/086

[52] U.S. Cl. ..... 280/613; 280/632; 280/634; 280/14.2; 36/118.2

[58] Field of Search ..... 280/613, 611, 280/14.2, 623, 633, 634, 636, 607, 615; 36/50.5, 117.1, 117.3, 88, 89, 115, 118.2

[56] References Cited

U.S. PATENT DOCUMENTS

| | | | |
|---|---|---|---|
| 3,061,325 | 10/1962 | Glass | 280/613 |
| 3,902,729 | 9/1975 | Druss | 280/613 |
| 3,925,911 | 12/1975 | Erlebach | 36/2.25 AL |
| 3,957,280 | 5/1976 | Turnheim et al. | 280/613 |
| 4,398,359 | 8/1983 | Chalmers, II | 36/117 |
| 4,836,872 | 6/1989 | Pozzobon | 280/613 |
| 4,973,073 | 11/1990 | Raines et al. | 280/624 |
| 4,998,358 | 3/1991 | Girardelli | 36/117 |
| 5,035,443 | 7/1991 | Kincheloe | 280/618 |
| 5,142,798 | 9/1992 | Kaufman et al. | 36/117 |
| 5,240,266 | 8/1993 | Kelley et al. | 280/204 |
| 5,499,461 | 3/1996 | Danezin et al. | 36/117 |
| 5,505,477 | 4/1996 | Turner et al. | 280/613 |
| 5,520,406 | 5/1996 | Anderson et al. | 280/624 |
| 5,595,396 | 1/1997 | Bourdeau | 280/613 |

FOREIGN PATENT DOCUMENTS

| | | |
|---|---|---|
| 0059022 | 9/1982 | European Pat. Off. . |
| 2466259 | 4/1981 | France . |
| 2641703 | 7/1990 | France . |
| 2705248 | 11/1994 | France . |
| 2329878 | 1/1974 | Germany . |
| 3622746 | 1/1988 | Germany . |
| WO91/11232 | 8/1991 | WIPO . |
| WO94/09660 | 5/1994 | WIPO . |
| WO94/26365 | 11/1994 | WIPO . |

*Primary Examiner*—Brian L. Johnson
*Assistant Examiner*—Avraham H. Lerner
*Attorney, Agent, or Firm*—Greenblum & Bernstein, P.L.C.

[57] ABSTRACT

A snowboard boot and an assembly of a snowboard boot and a retention apparatus for securing the boot to a snowboard. The boot includes a sole, an upper affixed to and extending upwardly from the sole, and an attachment member attached to the sole. The attachment member has a portion extending substantially longitudinally and spaced from a portion of the sole for facilitating engagement with a latch of the retention apparatus. The retention apparatus of the assembly includes an attachment mechanism for attaching in a vertical direction and along a horizontal plane, which cooperates with a complementary attachment mechanism of the boot, arranged in a central portion of the sole of the boot. The boot includes a skeleton that is constituted by a minimal force-transmission circuit which provides for the support necessary for practicing the gliding sport and the force-transmission circuit passes through the attachment mechanism of the boot. The integration of the boot having a minimal force-transmission circuit and its direct linkage with the attachment mechanism of the boot make it possible to ensure a good transmission of forces and support for a minimum space requirement of the retention apparatus.

38 Claims, 2 Drawing Sheets

SHOE/SHOE RETENTION DEVICE ASSEMBLY ON GLIDING ELEMENT

CROSS-REFERENCE TO RELATED APPLICATIONS

This application is a continuation of application Ser. No. 08/592,289, filed Mar. 22, 1996, now U.S. Pat. No. 5,887,886, which is the U.S. National Stage of PCT/FR95/00846, filed Jun. 26, 1995, and is a Continuation-In-Part of application Ser. No. 08/224,142, filed Apr. 4, 1994, now U.S. Pat. No. 5,595,396, issued Jan. 21, 1997. The entire disclosure of application Ser. No. 08/592,289 is considered as being part of the disclosure of this application, and the entire disclosure of application Ser. No. 08/592,289 is expressly incorporated by reference herein in its entirety.

BACKGROUND OF THE INVENTION

1. Field of the Invention

The present application is related to a shoe/shoe retention device assembly on a gliding element, notably on a snowboard.

2. Description of Background and Relevant Information

Snowboarding is a gliding sport in which both feet of the rider are on a single board and positioned obliquely with respect to the longitudinal axis of the board.

There are two origins for shoe/retention device assemblies corresponding to different dominant practices.

For a practice of the alpine type preferably carried out on a trail or packed snow, the shoes are of the alpine or cross-country ski type, rigid, in such a manner to allow for very sustained and precise support transmissions and edge settings. The retention elements cooperating with such shoes are generally stirrups locking each of the front and rear ends of each shoe sole. The rigidity of such shoe is generally obtained by a shell and a collar journalled made of plastic thus constituting a closed power circuit. This construction has the following disadvantages:

hinderance during the transition phases when the rider has only one shod foot on the board and pushes against in the snow with the second foot in order to moves, notably on flat terrain or in lines for ski lifts, hinderance during the movements that are necessary in the practice of snowboarding, particularly when the knee must move inwardly by a lateral flexion of the ankle, either to bend further, or to land from a jump, or to carry out figures during an airborne phase, filtration of the sensations coming from the board through the rigid sole, thus reducing much of the information circuit, hinderance during walking.

For a practice of the "soft" type preferably carried out on soft, non-packed, powdery snow, favoring jumps, side-slipping, and other figures, the shoes are very flexible and the necessary supports are essentially provided by retention elements in the form of an open shell and a journalled collar that are rigid, associated with straps, two or three per foot, allowing for the transmission of vertical forces from the bottom upward and forward.

Furthermore, the maintaining of the ankle and the instep is obtained by a diagonal strap substantially positioned at the level of the flexion fold and associated with a semi-rigid padded plate that distributes the pressure on the instep and ensures a progressiveness of the flexion of the heel, toward the front in particular.

These flexible shoes are essentially designed as sealed and comfortable shoes and having no role in the transmission of forces.

Therefore, they have the advantage of being comfortable and allowing a normal walk.

On the contrary, the retention elements with a shell are cumbersome and require a precise adjustment to the volume of the shoe during each operation for "putting on" the snowboard.

From the patent application FR No. 93.06006, now French Patent No. 2,705,248, published on Nov. 25, 1994, there has been proposed a device for retaining a snowboard shoe on a board by complementarity of the forms between the lower surface of the sole and the retention device, and the device for vertical latching.

Such a retention device has a particularly simple construction and is independent of the size of the shoe.

On the contrary, it requires a rigid sole and is therefore not compatible with shoes of the boot type with a flexible sole.

Such a retention device does not allow either the taking of support, transmissions of forces provided by the retention devices with a shell.

SUMMARY OF THE INVENTION

The object of the present invention is to resolve the herein above disadvantages and to provide a shoe/shoe retention device assembly on a gliding element such as a snowboard that has the advantages of the two systems of retention assemblies hereinabove described, without having the disadvantages thereof.

The assembly should notably provide a good compromise for the foot retention/comfort and transmission of the forces, support. It must likewise allow an easy insertion of the shoe and have a minimum space requirement.

Lastly, the shoe must be sufficiently flexible to allow walking with a certain movement of the foot.

This object is achieved in the shoe/retention device assembly according to the invention due the fact:

that the retention device comprises means for attachment in the vertical direction and along a horizontal plane cooperating with complementary shoe attachment means arranged in a central portion of the sole of the shoe, that the shoe comprises a skeleton constituting a minimal energy circuit for the transmission of forces and support necessary in the practice of the sport, and that this energy circuit passes through the attachment means of the sole of the shoe.

In this manner, the front and rear ends of the sole of the shoe can be left flexible and can thus gain the tactile and movement sensations necessary for walking.

Furthermore, the integration in the shoe of the minimal energy circuit, which corresponds to the power circuit constituted by the shell of a shell/boot assembly, and its direct linkage with the attachment means of the shoe allows to guarantee good transmission of forces and taking of support for a minimum space requirement of the retention device.

According to an advantageous embodiment of the retention device, the means for vertical attachment are of the latch type, and the means for attachment along a horizontal plane are constituted by forms that are complementary to the shoe and retention devices, ensuring a linkage along a longitudinal and transverse direction of this plane, for example, by an assembly of grooves/ribs of appropriate forms.

BRIEF DESCRIPTION OF THE DRAWINGS

In any case, the invention will be better understood, and other characteristics thereof will become evident with the help of the description that follows, with reference to the annexed schematic drawing and in which.

DETAILED DESCRIPTION OF THE INVENTION

Figure 1:
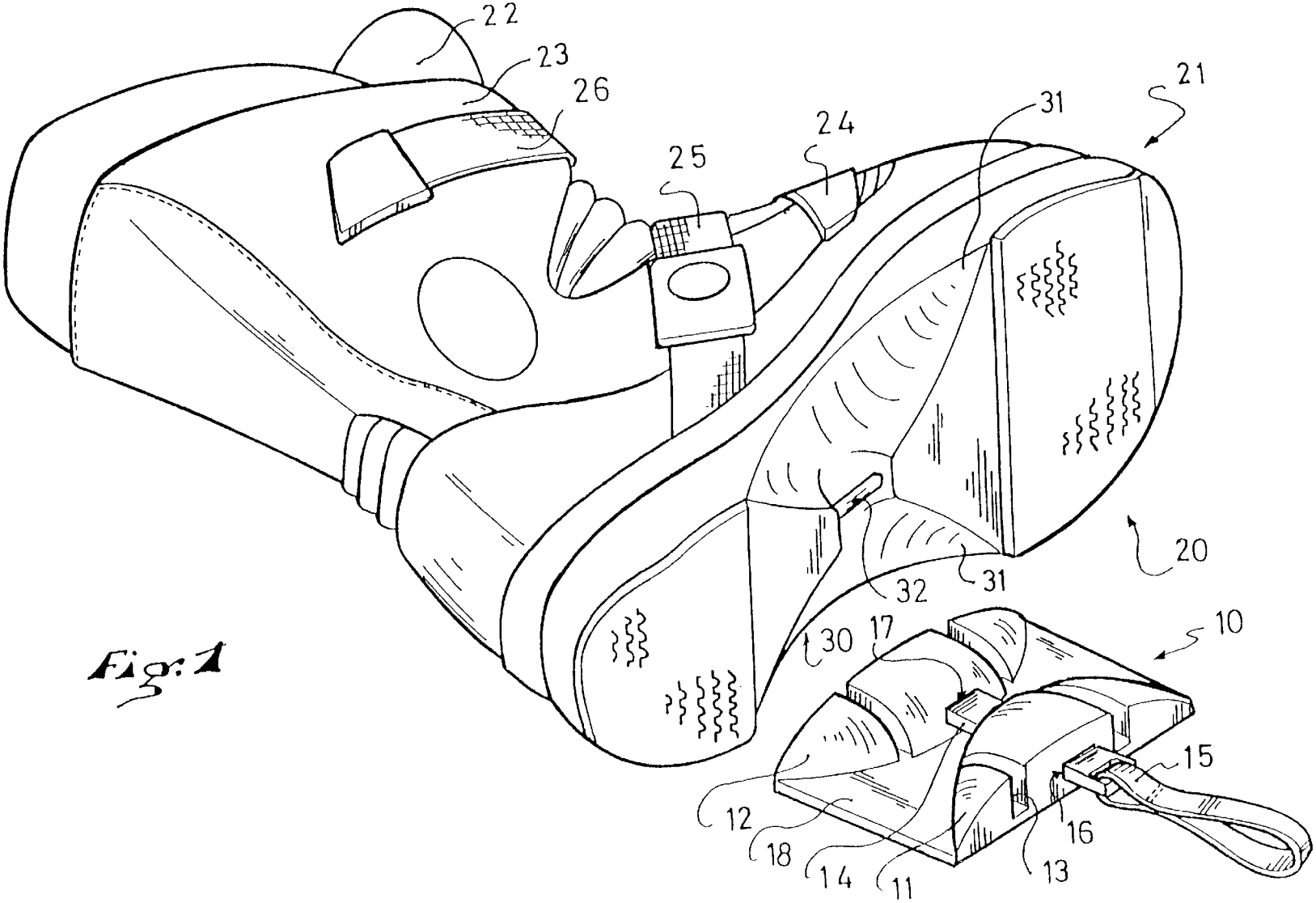
FIG. 1 is a perspective view of a shoe/retention device assembly according to one embodiment.

The shoe/retention device assembly shown in FIG. 1 comprises a retention device 10 adapted to be mounted on a gliding board or snowboard, and a shoe 20 comprising attachment means 30 complementary to those of the retention device.

The retention device 10 comprises projections in the form of two rounded ribs 11, 12 with a substantially trapezoidal shape and arranged opposite and forming, seen from the top, a sort of X.

Each of these ribs, 11, 12, can be interrupted by one or several slits 13, such as shown in the drawing, so as not to overly influence the bending capability of the board on which the retention device is mounted and to allow the evacuation of snow at the moment the shoe is put on.

The shoe complementary attachment means are constituted by two symmetrical recesses or grooves 31 arranged on both sides of the longitudinal axis of the shoe, and having shapes complementary to the ribs 11, 12.

These ribs 11, 12 and grooves 31 allow a form linkage between the shoe and the retention device in the horizontal plane of the snowboard, whereby the projecting form constituted by the ribs 11, 12 fits within said recessed form constituted by the recesses 31, 31.

Of course, other forms of ribs/grooves can be envisioned to the extent that they likewise allow for such a form linkage to be obtained along two perpendicular directions of the horizontal plane.

A locking plate, latch, or sash bolt 14 that can be operated by means of a handle 15 is slidably mounted in a slot 16 of the rib 11, and is capable of nesting in a recess 17 of the other rib 12.

This sash bolt 14 is adapted to cooperate with a latching member or pin 32 of the shoe, for the vertical latching of the shoe.

To this end, the space provided in the sash bolt 14 and the base 18 of the retention device just corresponds to the diameter of the attachment latching member 32.

By simple means, one thus obtains a latching of the shoe on the gliding element along the three degrees of freedom.

Of course, the sash bolt/latching member system can be reversed, the sash bolt being on the shoe and the latching member being on the retention device.

Likewise, the latching member 32 could be replaced by a flat iron piece or any other means for vertical retention could be provided without leaving the scope of the present invention.

In summary of the exemplary boot/retention device illustrated in FIG. 1, the retention device includes an attachment in the form of ribs 11, 12 and latch 14, whereas the boot has a complementary attachment in the form of recesses 31, 31 and latching member 32.

Figure 2:
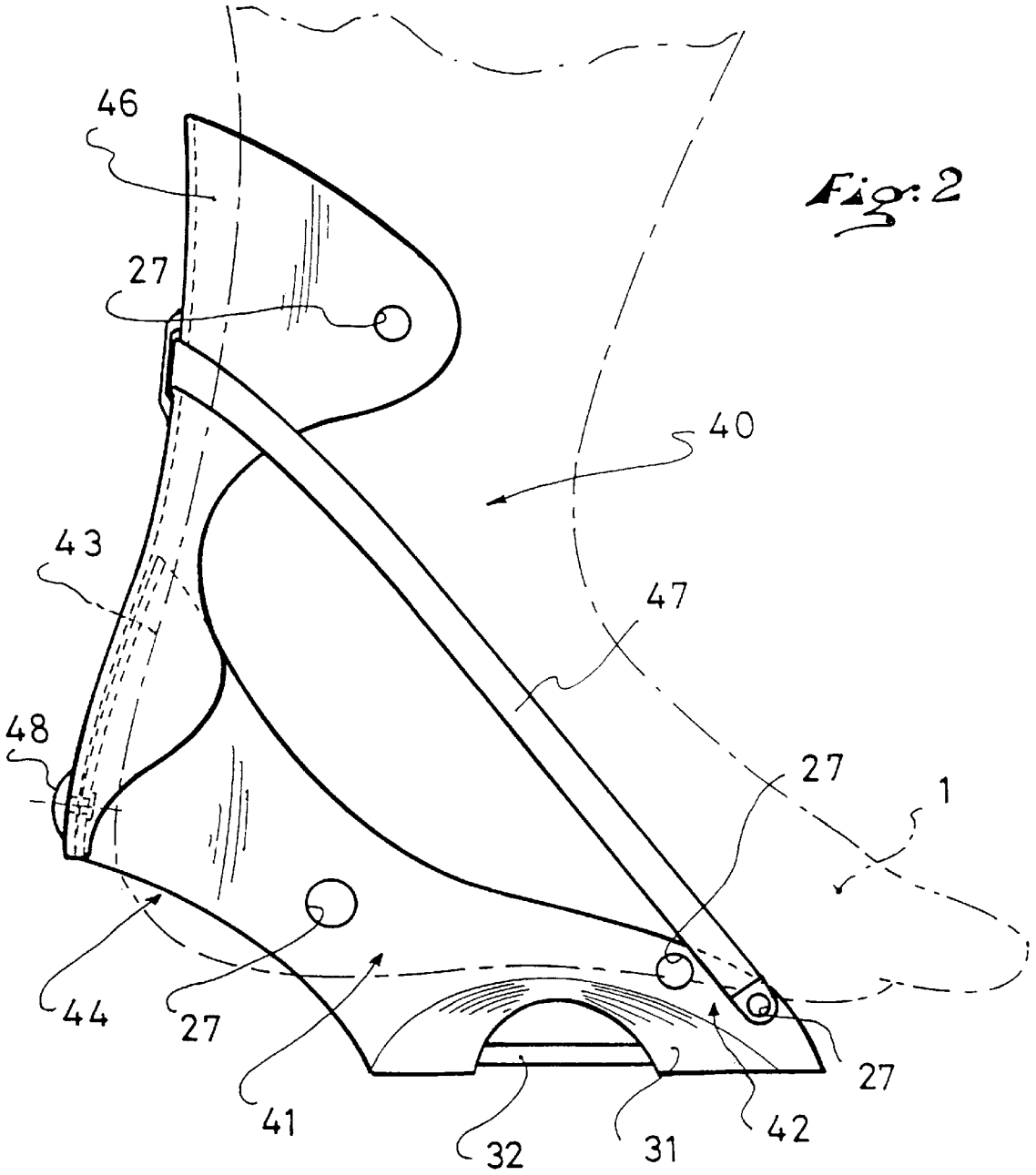
FIG. 2 is a side view of an example of the shoe skeleton.

FIG. 2 illustrates an embodiment of the shoe skeleton 40 adapted to allow a transmission of the forces and supports necessary to the practice of the sport.

For reasons related to lightness, but also to comfort, this skeleton 40 is minimal but provides an energy, or force transmission circuit corresponding to that provided by the shell of a retention device for a snowboard shoe of the boot type.

It is constituted by a rigid shell 41 surrounding the lower portion of the foot (represented in phantom lines as reference numeral 1) from the metatarsal zone 42 to the level of the Achilles tendon zone 43.

The shell 41, however, does not extend past the metatarsus so as to allow the tactile sensations at the level of the forefoot/toes.

Likewise, the shell 41 bears a wide scallop 44 at the level of the heel so as to allow the positioning of shock absorbing means at this level, and to allow tactile sensations of the heel, notably at the moment the step is begun, during walking or landing from a jump, so as to allow the sensation of the portion of the board that first touches the ground.

Furthermore, the shell 41 defines the recesses or grooves 31 and creates the permanent anchoring of the pin latching member 32. The shell 41 therefore completely integrates the anchoring means of the shoe that are thus directly connected to the power circuit.

As shown by the comparison of FIGS. 1 and 2, the shoe sole 21 can be overmolded glued or simply positioned on the central portion of the shell 41 and is made of a flexible and adhesive material such as synthetic or natural rubber, and by leaving the attachment portions 31, 32 exposed. As shown in FIG. 2 particularly, the attachment member 32 is thereby spaced below at least a portion of a lower surface of the boot by a dimension sufficient to allow reception of the latch 14 above the attachment member 32. The attachment member 32 thereby serves as the lower boundary of a circumscribed opening for the latch 14, the remainder of the opening being bounded by portions of the sole or surfaces of the recesses 31, the lower boundary 32 retaining the boot in engagement with the retention device 10.

In this manner, only the central portion of the sole 21 will be rigidified, the other portions thereof remaining flexible, and the tactile and foot movement sensations will be preserved.

A collar 46, extending from the top of the heel to the calf zone, is journalled on the rear portion 43 of the shell.

Similar to the shell 41, the collar has shapes and dimensions that are optimized so as to allow a transmission of forces and the support necessary to the practice of the sport without overly rigidifying the shoe.

More particularly, this collar 46 can be connected to the shell 41 by lateral stays 47 to allow a rear support in turns called "back side" without harming the forward flexion capability that is indispensable to the practice of snowboarding.

Similar to binding devices of the shell type, the essential role of the collar 46 is to ensure a rear abutment for the foot. In association with a strap 25 arranged on the instep, the collar participates in the control of the forward flexion of the leg by cooperation with the rear portion 43 of the shell 41.

One will note that in the example represented, the collar 46 is journalled on the shell 41 about a longitudinal axis by means of a journal member 48, such a construction allowing a great possibility for the leg to pivot in the transverse direction.

This journal member 48 could be replaced by a transverse journal journal member in the longitudinal direction of the shoe if more rigidity is desired in the transverse direction.

Of course, a liner 22 will be interposed between the skeleton 40 of the shoe and the foot 1 of the wearer, in a manner as to provide the necessary comfort.

This liner could be configured so as to offer the same sensations as a shoe of the traditional "boot" type.

Lastly, an exterior upper 23 will be provided to ensure the sealing of the assembly against snow/water, this upper being affixed to the sole 21 and preferably having the exterior aspect of a shoe of the traditional "boot" type.

The exterior upper 23 is provided, in a known manner, with closing and tightening means of the lacing type, or, as shown in the drawing, with straps 24, 25, 26, associated with attachment means of the buckle or self-gripping type.

In such a case, a tightening means or strap 25 is, more particularly, provided at the level of the instep.

As previously indicated, such a strap 25 cooperates with the collar 46 to control the flexion of the leg and, therefore, will be more or less flexible, so as to provide an information circuit very close to that of a shell/boot assembly.

All the anchoring means 27 of the different straps 24, 25, 26, or stays 47, are provided on the skeleton of the shoe, namely the shell 41 and the collar 46. These anchorings are obtained in any known manner, rivets, screws, etc. . .

In the case where the sole is not overcast or glued to the shell, it can simply be "threaded" and positioned thereon with the upper 23, and the attachment to the power circuit 41, 46 is then obtained by means of the anchoring means 27. Such an embodiment is particularly advantageous, for it allows the use of elements and technologies that are "standard" for the upper, the sole, the strap. Particularly, in the cases where the anchoring means 27 are screws, the assembly can be accomplished without particular tooling and can be removable.

According to that which precedes, one will understand that the invention makes it possible to obtain a snowboard shoe of the "boot" type having the advantages of such a shoe, but without having the disadvantages thereof, and being able to be, notably, associated with a retention device that is not very cumbersome and requires no adjustment.

A notable gain in weight and volume can also be obtained in the shoe/retention device assembly.

The invention is related not only to the shoe, but also to the associated retention device and the shoe/retention device thus obtained.

Of course, the present invention is not limited to the single embodiment hereinabove described by way of non-limiting example.

What is claimed:

1. A snowboard boot and retention apparatus comprising:

a boot having a sole extending longitudinally between front and rear;

an attachment member permanently affixed with respect to said sole against movement with respect to said sole, said attachment member having a portion spaced below at least a portion of a lower surface of said boot, said attachment member being positioned at a substantially central portion of said sole, said central portion being central between lateral sides of said sole and being central between front and rear ends of said sole; and a latching mechanism adapted to be secured to a snowboard, said latching mechanism comprising a latch guided for movement between an open position and a closed retention position, said attachment member being received by said latching mechanism in said open position of said latch and for being engaged by said latch in said closed retention position of said latch, whereby, in said closed retention position of said latch, said latch is positioned between said attachment member and said portion of said lower surface of said boot.

2. A snowboard boot and retention apparatus according to claim 1, wherein:

said attachment member comprises a longitudinally extending rod.

3. A snowboard boot comprising:

a lower surface extending longitudinally between front and rear; and an attachment member permanently affixed with respect to said lower surface against movement with respect to said lower surface, said attachment member having a portion spaced below at least a portion of said lower surface, and said attachment member being positioned at a substantially central portion of said sole, said central portion being central between lateral sides of said sole and being central between front and rear ends of said sole.

4. A snowboard boot according to claim 3, wherein:

said attachment member comprises a longitudinally extending rod.

5. A snowboard boot comprising:

a sole; and a longitudinally elongated attachment member permanently affixed with respect to said sole against movement with respect to said sole, said attachment member being positioned in a central portion of said sole, said central portion being central between lateral sides of said sole and being central between front and rear ends of said sole, said attachment member having at least a portion spaced below a downwardly facing surface of said sole for engagement of said attachment member by a latching mechanism of a binding apparatus.

6. A snowboard boot according to claim 5, wherein:

said attachment member comprises a longitudinally extending rod.

7. A snowboard boot according to claim 5, wherein:

said attachment member extends through a substantially longitudinal center of said sole and through a substantially lateral center of said sole.

8. A snowboard boot according to claim 5, wherein:

said attachment member comprises a member having opposite end portions extending into respective portions of said sole, and an exposed intermediate portion adapted to be engaged by said latching mechanism.

9. A snowboard boot adapted to be secured to a snowboard by a retention apparatus that includes a latch adapted to be secured to a snowboard and movable between an open position and a closed retention position, said boot comprising:

a sole;

an upper including:

a rigid internal skeleton extending upwardly from at least along a lateral side portion of said sole, said upper;

an exterior upper positioned over said rigid internal skeleton; and an attachment member affixed to said sole against movement with respect to said sole, said attachment member being rigidly affixed to said rigid internal skeleton, said attachment member having at least a portion spaced from a surface of said sole for being received by said latch, in said open position, and for being retained by said latch in said closed retention position.

10. A snowboard boot according to claim 9, wherein:

said attachment member comprises a longitudinally extending rod.

11. A snowboard boot according to claim 9, wherein:

a skeleton is secured to said sole and constitutes a force transmission circuit for transmitting and receiving forces during practice of snowboarding;

said attachment member is positioned in a central portion of said sole, whereby said force transmission circuit passes through said attachment member of said boot;

said force transmission circuit of said boot comprises a shell affixed to a central portion of said sole, said shell of said force transmission circuit bearing said attachment member.

12. A snowboard boot according to claim 11, wherein:

said boot has a front end portion and a rear end portion; and said shell of said force transmission circuit of said boot is open at said front end portion and said rear end portion of said boot.

13. A snowboard boot according to claim 11, wherein:

said shell of said force transmission circuit of said boot comprises:

a front end that does not extend forwardly beyond a metatarsus of a foot positioned within said boot so that toes and a forefoot of the foot project forwardly from said shell; and a rear end that includes an opening that begins forwardly of a heel of the foot so that the heel of the foot projects rearwardly from said shell.

14. A snowboard boot according to claim 11, wherein:

said force transmission circuit further comprises a collar journalled to said shell.

15. A snowboard boot according to claim 14, further comprising:

a plurality of stays connecting said collar to said shell.

16. A snowboard boot according to claim 14, wherein:

said collar is journalled to said shell by a transverse journal connection located at a rear portion of said shell.

17. A snowboard boot according to claim 14, wherein:

said collar is journalled to said shell by a longitudinally extending journal connection located at a rear portion of said shell.

18. A snowboard boot according to claim 11, wherein:

said sole of said boot is affixed to said shell of said force transmission circuit by being molded onto said shell.

19. A snowboard boot according to claim 11, wherein:

said boot further comprises an upper positioned outside of said skeleton.

20. A snowboard boot according to claim 9, further comprising:

closing and tightening elements affixed to said upper.

21. A snowboard boot according to claim 20, wherein:

said closing and tightening elements comprise a plurality of straps, each of said straps being anchored to said skeleton of said boot.

22. A snowboard boot according to claim 21, wherein:

said upper is assembled to said force transmission circuit by means of said straps being anchored to said skeleton of said boot.

23. A snowboard boot comprising:

a sole extending in a longitudinal direction;

an upper affixed to and extending upwardly from said sole; and an attachment member permanently anchored with respect to said sole against movement with respect to said sole, said attachment member having a portion extending substantially in said longitudinal direction and spaced from said sole for facilitating engagement of said attachment member with a latch of a binding device.

24. A snowboard boot according to claim 23, wherein:

said attachment member is positioned at a substantially central portion of said sole, said central portion being central between front and rear ends of said sole.

25. A snowboard boot according to claim 24, wherein:

said central portion is central between lateral sides of said sole.

26. A snowboard boot according to claim 23, wherein:

said sole has a lowermost surface extending substantially horizontally; and said attachment member extends substantially horizontally.

27. A snowboard boot according to claim 23, wherein:

said attachment member comprises a longitudinally extending rod.

28. A snowboard boot according to claim 23, wherein:

said boot comprises a circumscribed opening for the latch, said attachment member comprising a lower boundary of said circumscribed opening.

29. A snowboard boot comprising:

a longitudinally extending sole;

an exterior upper affixed to and extending upwardly from said sole;

a rigid shell, said sole and said exterior upper being affixed to said rigid shell; and an attachment member integrated with said rigid shell and attached to said sole against movement with respect to said sole, said attachment member having a portion extending substantially in said longitudinal direction and spaced from said sole for facilitating engagement of said attachment member with a binding device.

30. A snowboard boot according to claim 29, wherein:

said attachment member is permanently affixed to said rigid shell.

31. A snowboard boot according to claim 29, wherein:

said rigid shell extends from a lateral side of a foot of a wearer, transversely along and beneath the foot, to a medial side of the foot of a wearer, and at least from a metatarsal zone, longitudinally along and beneath the foot, and at least to a front of a heel zone of the foot.

32. A snowboard boot according to claim 29 wherein:

said attachment member is positioned at a substantially central portion of said sole, said central portion being central between front and rear ends of said sole.

33. A snowboard boot according to claim 32, wherein:

said central portion is central between lateral sides of said sole.

34. A snowboard boot comprising:

a longitudinally extending sole;

an exterior upper affixed to and extending upwardly from said sole;

a rigid shell, said exterior upper being affixed to said rigid shell and said sole being overmolded onto said rigid shell; and an attachment member integrated with said rigid shell and attached to said sole against movement with respect to said sole, said attachment member having a portion extending substantially in said longitudinal direction and spaced from said sole for facilitating engagement of said attachment member with a binding device.

35. A snowboard boot according to claim 34, wherein:

said attachment member is permanently affixed to said rigid shell.

36. A snowboard boot according to claim 34, wherein:

said rigid shell extends from a lateral side of a foot of a wearer, transversely along and beneath the foot, to a medial side of the foot of a wearer, and at least from a metatarsal zone, longitudinally along and beneath the foot, and at least to a front of a heel zone of the foot.

37. A snowboard boot according to claim 34 wherein:

said attachment member is positioned at a substantially central portion of said sole, said central portion being central between front and rear ends of said sole.

38. A snowboard boot according to claim 37, wherein:

said central portion is central between lateral sides of said sole.

* * * * *